United States Patent [19]

Germerdonk et al.

[11] 4,217,316

[45] Aug. 12, 1980

[54] IMMERSED SAFETY DEVICE AND METHOD FOR PROTECTION AGAINST BACK-FIRE IN EXPLOSIVE GAS STEAMS

[75] Inventors: Rolf Germerdonk, Bergisch-Gladbach; Adam Jonas, Leichlingen; Claus Gockel, Odenthal-Glöbusch; Werner Hüning, Odenthal-Hahnenberg; Götz-Gerald Börger, Monheim, all of Fed. Rep. of Germany

[73] Assignee: Bayer Aktiengesellschaft, Leverkusen, Fed. Rep. of Germany

[21] Appl. No.: 900,687

[22] Filed: Apr. 27, 1978

[30] Foreign Application Priority Data

May 14, 1977 [DE] Fed. Rep. of Germany ..... 2721871

[51] Int. Cl.[2] ..... B01F 3/04

[52] U.S. Cl. ..... 261/123; 48/192; 261/124

[58] Field of Search ..... 261/122–124, 261/77, DIG. 47; 210/242 S; 48/192; 55/257 R, 259

[56] References Cited

U.S. PATENT DOCUMENTS

| | | | |
|---|---|---|---|
| 117,998 | 8/1871 | Edgerton | 261/124 X |
| 839,319 | 12/1906 | Rateau | 261/124 X |
| 2,216,664 | 10/1940 | Fremd, Jr. | 261/124 X |
| 2,989,186 | 6/1961 | Weis | 261/DIG. 47 |
| 3,792,688 | 2/1974 | Grainger | 261/124 X |
| 3,804,251 | 4/1974 | Farrell et al. | 210/242 S X |
| 3,926,810 | 12/1975 | Gudernatsch et al. | 261/124 X |
| 3,938,738 | 2/1976 | Nagel et al. | 261/77 X |
| 4,076,617 | 2/1978 | Bybel et al. | 261/124 X |
| 4,098,853 | 7/1978 | Brown et al. | 261/122 |

FOREIGN PATENT DOCUMENTS

| | | | |
|---|---|---|---|
| 719,852 | 2/1932 | France | 261/124 |
| 1059261 | 3/1954 | France | 261/124 |

*Primary Examiner*—Richard L. Chiesa

*Attorney, Agent, or Firm*—Sprung, Felfe, Horn, Lynch & Kramer

[57] ABSTRACT

An apparatus and method for the protection of a pipe containing an inflammable gas against back fire. The apparatus comprises a container partially filled with liquid extending along a given length of the container and at a give level, at least one gas feed pipe, and at least one horizontal inlet pipe, each immersed in the liquid and sealed at one end and receptive of gas at the other end from the feed pipe. Each inlet pipe has holes in its circumferential surface for the introduction of the gas into the liquid, with the number of holes and the dimensions thereof such that at the maximum gas volume flow rate, the outflow rate through the holes is at the most 40 m/sec and the rate in each gas feed pipe is at the most 20/sec. Additionally, each inlet pipe extends over only part of the length of the liquid in the container. A gas outlet nozzle is positioned above that part of the container where there is no pipe and a calming grid is disposed at the liquid level to subdue waves in the liquid.

14 Claims, 3 Drawing Figures

IMMERSED SAFETY DEVICE AND METHOD FOR PROTECTION AGAINST BACK-FIRE IN EXPLOSIVE GAS STEAMS

The invention relates to a method and an apparatus for the protection of a pipe containing an inflammable gas against back-fire. It is based on the known principle of the immersed safety device, in which the explosive gas stream is fed through a layer of liquid. The apparatus required for this purpose consists of a container, partially filled with a liquid, and at least one horizontal inlet pipe sealed off at the end and immersed in the liquid, having holes for the gas to flow out into the liquid.

Such apparatus has been known for many years and is commercially available. However, investigations have shown that these immersed safety devices do not operate reliably in all cases. Continuous gas filled channels, through which back-fire is possible, may be formed between the feed pipe and the surface of the liquid. This problem arises, in particular with large volume flows.

The object of the invention is to improve the reliability of the immersed safety devices and to allow perfect and reliable operation, particularly with large gas volume flow rates.

According to the invention there is provided a method and an apparatus for the protection of a pipe containing an inflammable gas against back-fire comprising, a container partially filled with liquid and at least one horizontal inlet pipe immersed in the liquid and sealed at the end, having holes in its circumferential surface for the introduction of the gas into the liquid, wherein the number of holes and the dimensions thereof are such that at the maximum gas volume flow rate, the outflow rate through the holes is at the most 40 m/sec and the rate in gas feed pipe or pipes is at the most 20 m/sec, the said at least one inlet pipe extends only over part of the overall length of the said liquid in the container, and above that part of the container which is pipeless is arranged a gas outlet nozzle, and a calming grid is arranged in the vicinity of the surface of the liquid to subdue waves in the liquid.

The special dimensioning of the holes in the inlet pipes ensures that the gas can flow through the layer of liquid only in the form of finely divided small individual bubbles. This prevents the formation of coherent gas channels in the layer of liquid. The partitioning of the container to give a pipeless part with the gas outlet nozzle located in this part ensures that an explosive impact entering the container from the nozzle cannot expose the inlet pipes. The calming grid on the surface of the liquid considerably subdues waves in the liquid which would lead to instabilities in the gas stream. The reliability of the immersed safety device is improved substantially by combining these measures.

The holes in the lower half of the surface of the inlet pipes are preferably from 3 to 10 mm in diameter and are directed at 45° to the normal. With regard to the coalescence of the gas bubbles, it is desirable for the holes to be offset with respect to each other. For the same reason, the distance between the holes should be at least 2d, preferably from 2.5 to 3d (d=mean distance across the hole, said distance being that between the intersection points of a straight line, drawn to pass through the centre of gravity of the hole shape, with the perimeter of the said hole). If the gas volume flow rate is so large that too great a linear flow-rate (≧20 m/sec) is produced in an immersed safety device with only one inlet pipe, then the draw on the blocking layer of liquid by the gas jets will be too great owing to the too high a rate of outflow (≧4.0 m/sec) from the holes, and after their formation the requirement of separate individual gas bubbles can no longer be met reliably. Several parallel inlet pipes with rows of holes of equal immersion depth are then advantageously arranged one beside the other in the container. The free interval from one pipe to the next should be at least 50 mm so as to prevent a counteracting influence upon the gas jets flowing out of the holes. the arrangement of several parallel inlet pipes also allows various gas streams to be introduced free from the danger of back-fire so that an immersed gas stream cannot reach the source of another gas stream at the same time. This is particularly important if the substances present in a waste gas stream would react undesirably with the products present at the source of another waste gas stream.

With reference to the accompanying drawings.

Figure 1:
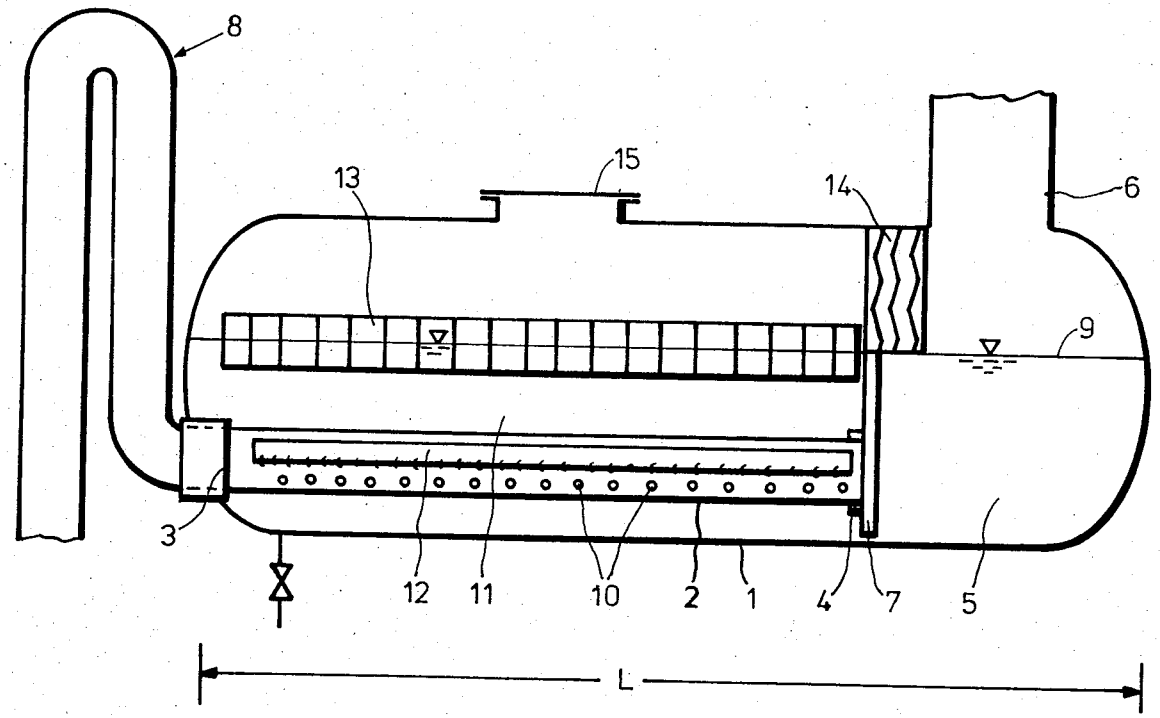
FIG. 1 shows a diagrammatic view of the entire immersed safety device.

The main constituent of the immersed safety device is a horizontal cylindrical pressure-resistant container (1) which is partially filled with a liquid, preferably water. One or more horizontal gas inlet pipes (2) are installed in an airtight manner above the bottom of the container, by means of flanges (3) and (4), in such a way that the pipes (2) may be adjusted to lie exactly horizontally. The length of the pipe (2) is such that they extend over approximately two-thirds of the overall length of the container. Consequently there exists a space (5) at the right-hand end of the container which has no inlet pipes. The gas outlet nozzle (6) is located in this pipeless part (5). The blind flanges (4) at the end of the gas inlet pipes (2) are connected to a vertical plate (7) which divides the liquid chamber (5) located beneath the gas outlet nozzle (6) to within narrow tolerences from the rest of the liquid chamber. However, the flow of gas via the inlet pipes (2) is not impaired by the vertical shielding plate (7). With this design, an explosion from the nozzle (6) can blow the liquid out of the chamber (5) but can not expose the pipe (2) or pass into the gas feed pipe (8). The gas feed pipe (8) is U-shaped and opens from above into the gas inlet pipe (2). The highest point of the feed pipe (8) is located above the level of liquid (9) so that water is prevented from being forced back into the gas feed pipes during momentary excess-pressure in the container (1). At the same time, this syphon-like arrangement prevents the immersed safety device from being sucked empty when several gas streams are introduced separately therein if excess-pressure is inadvertently produced in one of the gas feed pipes.

The inlet pipes (2) are provided on their underside with one or more rows of holes (10) having diameters d=3–10 mm, through which the gas flows into the layer of liquid (11). The free pipe cross-section $A_R$ should be larger than the total opening area of all holes $A_B$ so that the pressure loss in the gas flow is mainly across the holes 10. It has proved successful to select dimensions according to $A_R=2A_B$, wherein $A_B$ represents the cross-section of a hole 10 multiplied by the number of holes in a pipe. The holes (10) are not arranged along a straight line but are offset with respect to each other as in FIG. 3. The holes are also directed at an angle of about 45° to the normal. The intervals i thereof along the axis of the pipe should be larger than twice the diameter d of the hole, preferably ≧2.5 to 3d. The fineness of the holes and the special arrangement thereof causes the gases to be divided into small individual bubbles which rise separately in the layer of liquid (11).

The diameter D of the inlet pipe (2) is limited by the hydro-static pressure to be overcome in the layer of liquid (11) across the holes (10) (height h see FIG. 2) and lies between 100 and 250 mm in this embodiment. In addition, a minimum cover $h_1=30$ mm must always be maintained above the inlet pipes (2) so as to protect the inflowing gas from unallowable heating if a pilot light is to be formed above the level of liquid (9) in the case of a flash-back.

The maximum gas volume flow rate determines the number of inlet pipes (2) used. At low volume flow rates, one inlet is sufficient. However, if the volume flow rate is so great that the outflow rate from the holes (10) would exceed 40 m/sec and the rate in the feed pipes would exceed 20 m/sec, then the draw on the blocking liquid is by the gas jets, is too great and the formation of individually separated gas bubbles is disturbed to a noticeable degree. In this case, several inlet pipes (2) would be arranged next to each other and connected to the feed pipe via a distributor (not shown). The interval between the pipes (2) is to be at least 50 mm in this case so as to prevent a counteractive effect of the gas jets flowing out of the holes.

Figure 3:
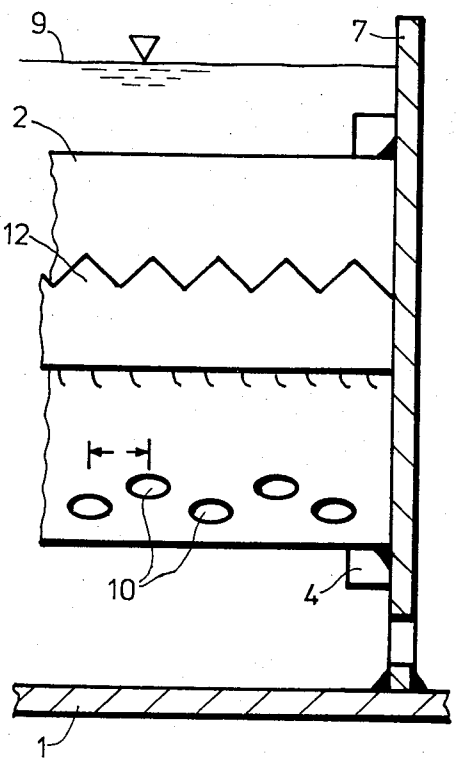
FIG. 3 shows partial detail of the inlet pipe in the illustration in FIG. 1.
Figure 2:
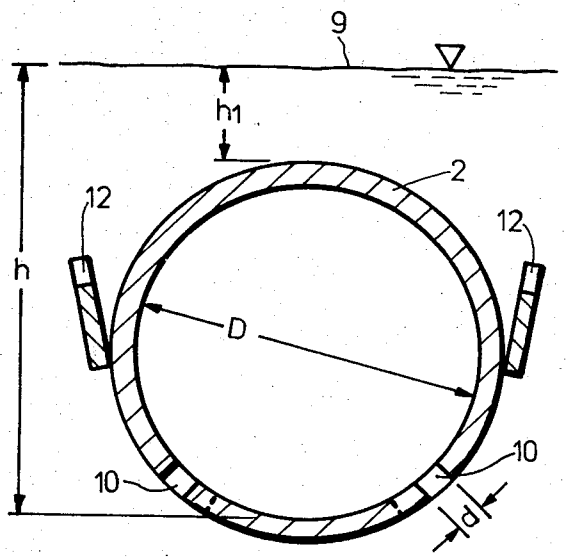
FIG. 2 shows an enlarged side view of the inlet pipe.

Deflecting plates (12) pointing obliquely upwards are arranged on the circumference of the inlet pipe (2), which deflecting plates (12) are serrated at their upper edge (see FIGS. 2 and 3). They prevent the individual gas bubbles from coalescing as they rise to form larger bubbles. This would reduce the safety from back-fire.

A calming grid (13) is arranged at the level of liquid (9) in the container and is composed, for example, of a steel grid having a mesh width of from 40 to 60 mm. This grid prevents the gushes of liquid from surging back and forth, particularly in the case of high gas volume flow rates. A uniform flow of bubbles in the layer of liquid (11) is a required condition for high security from the danger of back-fire. The above-mentioned undulating movement of liquid leads, from experience, to instabilities in the flow of bubbles and promotes the formation of continuous gas filled channels between the surface of the liquid (9) and the inlet pipes (2). The calming grid (13) also prevents the layer of liquid (11) from being blown away from its position over the inlet pipes (2) in the case of a back-fire, so that the gas front receding from the outlet nozzle, reaches the surface of liquid (9) as a shock wave.

An easily exchangeable mist eliminator (14), whose ability to function is checked after the occurence of detonations, is installed at right angles above the vertical shielding plate (7) separating the flow chamber from the pipeless part (5) in the container (1).

A rupture plate (15) may be installed on the upper side of the container (1) to protect it against prolonged excess-pressure. An alarm signal and an automatic switch-over to disturbed operation is activated by a disturbance of this rupture plate (15).

What we claim is:

1. An apparatus for the protection of a pipe, containing an inflammable gas, against backfire comprising a container partially filled with liquid extending along a given length of the container and at a given level; at least one gas feed pipe; at least one horizontal inlet pipe, each immersed in the liquid and sealed at one end and receptive of gas at the other end from the feed pipe, wherein each inlet pipe has holes in its circumferential surface for the introduction of the gas into the liquid, and wherein each inlet pipe extends over only part of the length of the liquid in the container; a gas outlet nozzle positioned above that part of the container where there is no pipe; and a calming grid disposed at the liquid level to subdue waves in the liquid with a portion disposed below the liquid level and a portion disposed above the liquid level.

2. An apparatus according to claim 1, wherein the holes have a mean diameter d of from 3 to 10 mm.

3. An apparatus according to claim 2, wherein the holes are disposed in the lower half of the circumferential surface of each inlet pipe and are directed at 45° to the normal.

4. An appratus according to claim 3, wherein the holes are offset with respect to each other.

5. An apparatus according to claim 4, wherein the distance between the holes is at least 2d.

6. An apparatus according to claim 5, wherein the distance between the holes is from 2.5 to 3d.

7. An apparatus according to claim 1 comprising a plurality of inlet pipes wherein the distance between the parallel inlet pipes is at least 50 mm.

8. An apparatus according to claim 1, further comprising deflecting plates connected to each inlet pipe above the holes thereof to prevent gas bubbles from coalescing on the upper side of the pipe.

9. An apparatus according to claim 1, further comprising a vertical shielding plate dividing the portion of the container where no pipe is present from the remainder of the container and sealing flanges for sealing the one end of each inlet pipe and mounted on the shield.

10. An apparatus according to claim 9, wherein the flange seals effect each inlet pipe to be adjustable in the vertical direction.

11. An apparatus according to claim 1, further comprising a mist eliminator removably mounted in the container between the pipeless part and the remaining part of the container.

12. An apparatus according to claim 1, wherein each feed pipe to the container opens from above into one inlet pipe and forms a syphon-like block for the liquid.

13. An apparatus according to any one of claims 1 to 12, wherein the overall cross-sectional area of all holes of one gas feed pipe is about half of the inner cross-sectional area of the pipe.

14. A method for the protection of a pipe, containing an inflammable gas, against backfire comprising: introducing the gas through holes in the circumferential surface of at least one inlet pipe into a liqiud which partially fills its container, each inlet pipe being sealed at one end and immersed in the liquid, the holes being such that at the maximum gas volume flow rate, the outflow rate through the holes is at the most 40 m/sec and the rate in each feed pipe to the inlet pipes is at the most 20 m/sec, with each inlet pipe extenging over only part of the overall length of the liquid, discharging the gas via an outlet nozzle arranged above that part of the container which is pipeless, and subduing any waves formed in the liquid during use by a calming grid arranged at the surface of the liquid.

* * * * *